US010821492B2

(12) United States Patent
Yeo

(10) Patent No.: US 10,821,492 B2
(45) Date of Patent: Nov. 3, 2020

(54) STRAPPING HEAD MODULE FOR COIL PACKAGING

(71) Applicant: SAM JUNG JPS CO., LTD, Gimhae-si (KR)

(72) Inventor: Dong Hoon Yeo, Gimhae-si (KR)

(73) Assignee: SAM JUNG JPS CO., LTD, Gimhae-si (KR)

( * ) Notice: Subject to any disclaimer, the term of this patent is extended or adjusted under 35 U.S.C. 154(b) by 217 days.

(21) Appl. No.: 15/548,486

(22) PCT Filed: Sep. 27, 2016

(86) PCT No.: PCT/KR2016/010821
§ 371 (c)(1),
(2) Date: Jul. 13, 2018

(87) PCT Pub. No.: WO2017/175932
PCT Pub. Date: Oct. 12, 2017

(65) Prior Publication Data

US 2018/0311716 A1 Nov. 1, 2018

(30) Foreign Application Priority Data

Apr. 8, 2016 (KR) ..... 10-2016-0043266

(51) Int. Cl.

| | |
|---|---|
| ***B65B 13/02*** | (2006.01) |
| ***B65B 13/18*** | (2006.01) |
| ***B65B 13/22*** | (2006.01) |
| ***B65B 13/32*** | (2006.01) |
| ***B65B 27/06*** | (2006.01) |
| ***B21C 47/24*** | (2006.01) |
| ***B65B 13/04*** | (2006.01) |

(52) U.S. Cl.
CPC ..... *B21C 47/24* (2013.01); *B65B 13/04* (2013.01); *B65B 13/22* (2013.01); *B65B 13/32* (2013.01); *B65B 27/06* (2013.01)

(58) Field of Classification Search
CPC ..... B65B 13/04; B65B 13/06; B65B 13/18; B65B 13/22; B65B 13/30; B65B 13/32; B65B 27/06; B21C 47/24
USPC ..... 100/26, 29, 32, 33 R
See application file for complete search history.

(56) References Cited

U.S. PATENT DOCUMENTS

| | | | | |
|---|---|---|---|---|
| 4,559,767 | A | 12/1985 | Takami | |
| 4,689,938 | A | 9/1987 | Zoppa | |
| 4,791,968 | A * | 12/1988 | Pearson | B65B 13/30 140/93.2 |
| 4,845,928 | A * | 7/1989 | Sakaki | B65B 13/184 53/589 |
| 4,938,009 | A | 7/1990 | Takami | |
| 6,584,891 | B1 * | 7/2003 | Smith | B65B 13/06 100/26 |
| 7,428,867 | B1 | 9/2008 | Bell, Jr. | |

(Continued)

*Primary Examiner* — Jimmy T Nguyen
(74) *Attorney, Agent, or Firm* — Baker Donelson

(57) ABSTRACT

A strapping head module for coil packaging convenient in maintenance and repair and guaranteed in packaging quality by being manufactured in small and light way and performing an accurate operation. The inventive module includes a frame, a correction unit arranged at one side of the frame to correct a curvature of supplied band, a feeding unit, a guide unit, a grip unit, and a binding unit binding an overlapped band.

9 Claims, 9 Drawing Sheets

(56) References Cited

U.S. PATENT DOCUMENTS

| | | | | |
|---|---|---|---|---|
| 2003/0010226 | A1* | 1/2003 | Flaum | B65B 13/18 100/26 |
| 2009/0108042 | A1 | 4/2009 | Pearson et al. | |
| 2013/0276415 | A1 | 10/2013 | Haberstroh et al. | |
| 2016/0016682 | A1* | 1/2016 | Boss | B65B 13/22 100/4 |

* cited by examiner

STRAPPING HEAD MODULE FOR COIL PACKAGING

CROSS-REFERENCE TO RELATED APPLICATION(S)

The present application is based on, U.S. National Phase entry from International Application No. PCT/KR2016/010821, filed Sep. 27, 2016 which claims priority to Korean Patent Application Number, 10-2016-0043266 filed on Apr. 8, 2016, the disclosure of which is incorporated by reference herein in its entirety.

BACKGROUND OF THE INVENTION

1. Field of the Invention

The present invention generally relates to a strapping head module for coil packaging, and more particularly to a strapping head module for coil packaging applicable to strapping machine for strapping a band for packaging a steel plate coil.

2. Description of the Background

In general, a strapping facility is used in a steel mill to package a steel product such as a steel plate coil by strapping the steel plate coil, and a band necessary for strapping a coil is required in order to perform a packaging work such as above. A work is performed in such a way that the band is supplied to a head module of a strapping machine in a strapping facility by being unwound from a band coil wound in a coil shape, and the band is wound in a circumferential direction of a coil through a guide or in a right angle direction of a circumference through a minor diameter part of a coil, welded or sealed and cut.

At this time, the head module takes an important functional role in the strapping machine, and is one of important elements performing operations of band supply, provision of tension, welding (or sealing) and cutting. The head module has been proposed in various shapes according to structure of strapping machine. For example, the Korean Patent Registration No.: 967445 disclosed a constitution of a head unit for coil packaging, the head unit comprising a band transfer unit and a band binding unit, where the band transfer unit transfers a robot to a location in which the robot can catch the front end of a band, and according as the robot provides the front end of the band wound in a coil, the band transfer unit transfers the front end of the band so that the front end of the band is stacked with the band, and the band binding unit binds the front end of band to the band.

Furthermore, the Korean Patent Registration No.: 946340 also discloses a constitution of a head unit for coil packaging, the head unit comprising: a grip unit for gripping a band used for packaging of a coil; a grip robot supporting the grip unit, rotating the grip unit gripping the band about a circumference of the coil to allow the band to be wound on the coil, and moving the band to a bound position of the band; a head unit providing the band to the grip unit and to bind the band at the bound position of the band; a head robot supporting the head unit to move the head unit to a bound position of the band; and a robot transfer unit supporting at least one of the head robot and the grip robot and transferring the supported position of the robot.

Furthermore, the published Korean Patent No.: 2012-0093171 discloses a constitution of a strapping machine for tying packages, comprising: a tensioning device and a welding device for connecting the ends of the strapping bands that are stretched under tension, said welding device comprising at least one upper advanceable welding electrode in an electrode chamber; a counter electrode that temporarily interacts with said welding electrode; and a sliding plate associated with the welding devie towards the package.

Although the head modules disclosed in the inventions thus discussed have characteristics of increasing interaction with peripheral equipment, the abovementioned head modules suffer from disadvantages in that partial operational defects in band feeding and tension application during a long hour-use due to complicated configuration such as air motor driving of band, the defects of which result in disablement of control in accurate band overlapped portion part and loss in bands. As a result, the use life is shortened, and a new structure of coil packaging strapping head module is required that is capable of performing a relatively accurate operation.

SUMMARY OF THE INVENTION

Therefore the present invention is provided to solve the abovementioned conventional problems/disadvantages, and therefore, the technical subject to be solved by the present invention is to provide a strapping head module for coil packaging convenient in maintenance and repair and guaranteed in packaging quality by being manufactured in small and light way and performing an accurate operation.

In one general aspect of the present invention, there is provided a strapping head module for coil packaging applicable to a strapping machine for packaging a steel plate coil, comprising:

a frame formed by being combined with a plurality of plates;

a correction unit arranged at one side of the frame to correct a curvature of supplied band;

a feeding unit configured to transfer a correction unit passed band and to apply a tension to the band after the band completely wind a coil;

a guide unit configured to switch the band transferred by the feeding unit and to detect a tension applied to the band;

a grip unit clamping an end of the band and to cut off the end; and a binding unit binding an overlapped band.

Preferably, but not necessarily, the correction unit may include:

a correction base fixed to the frame;

a correction moving unit transferably coupled to the correction base;

a correction actuator transferring the correction moving unit; and a correction roller arranged on the correction base and the correction moving unit in a zigzag manner to transfer the hand.

Preferably, but not necessarily, the feeding unit may include:

a driving roller operated by a feeding motor;

a driven roller rolling by being meshed with a gear formed at the driving roller; and a moving actuator moving a rotation shaft of the driven roller.

Preferably, but not necessarily, a central axis of the driven roller may be eccentrically formed by as much as meshing between the feeding unit and the gear.

Preferably, but not necessarily, a driven motor driving the driving roller may be horizontally arranged at an outside of the frame and meshed through the driving roller and a bevel gear.

Preferably, but not necessarily, the guide unit may include:

a hinge unit hinged at one end to the frame;

a guide groove formed thereinside to guide the band; and a load cell fixed to the frame to detect a rotating force (torque) of the guide unit.

Preferably, but not necessarily, the grip unit may include:

a grip actuator;

a jaw body gripping the transferred band and cutting the band; and a booster unit transmitting an operation of the grip actuator to the jaw body.

Preferably, but not necessarily, the distribution body may include an input link connected to an operation unit of the grip actuator, an output link connected to an operation unit of the jaw body and three links, wherein an end of the links, each connected by a hinge, includes an intermediate link hinged to the frame, and the input link and the output link are respectively connected to a hinge unit of the intermediate links.

Preferably, but not necessarily, the binding unit may be a welding unit or a sealing unit.

The strapping head module for coil packaging according to the present invention has an advantageous effect in that the strapping head module is configured by including a frame, a correction unit, a feeding unit, a guide unit, a grip unit and a coupling unit, it is advantageous in maintenance and repair because of convenience in assembly and disassembly according to a frame formed with a plurality of members, an electrically-drivable feeding unit and a guide unit detecting tension of band, and accurate band binding is possible due to excellent control characteristic to thereby enable to realize a performance of high quality packaging.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION OF THE PREFERRED EMBODIMENTS

Hereinafter, exemplary embodiments of the present invention will be described in detail with reference to the accompanying drawings.

Figure 1:
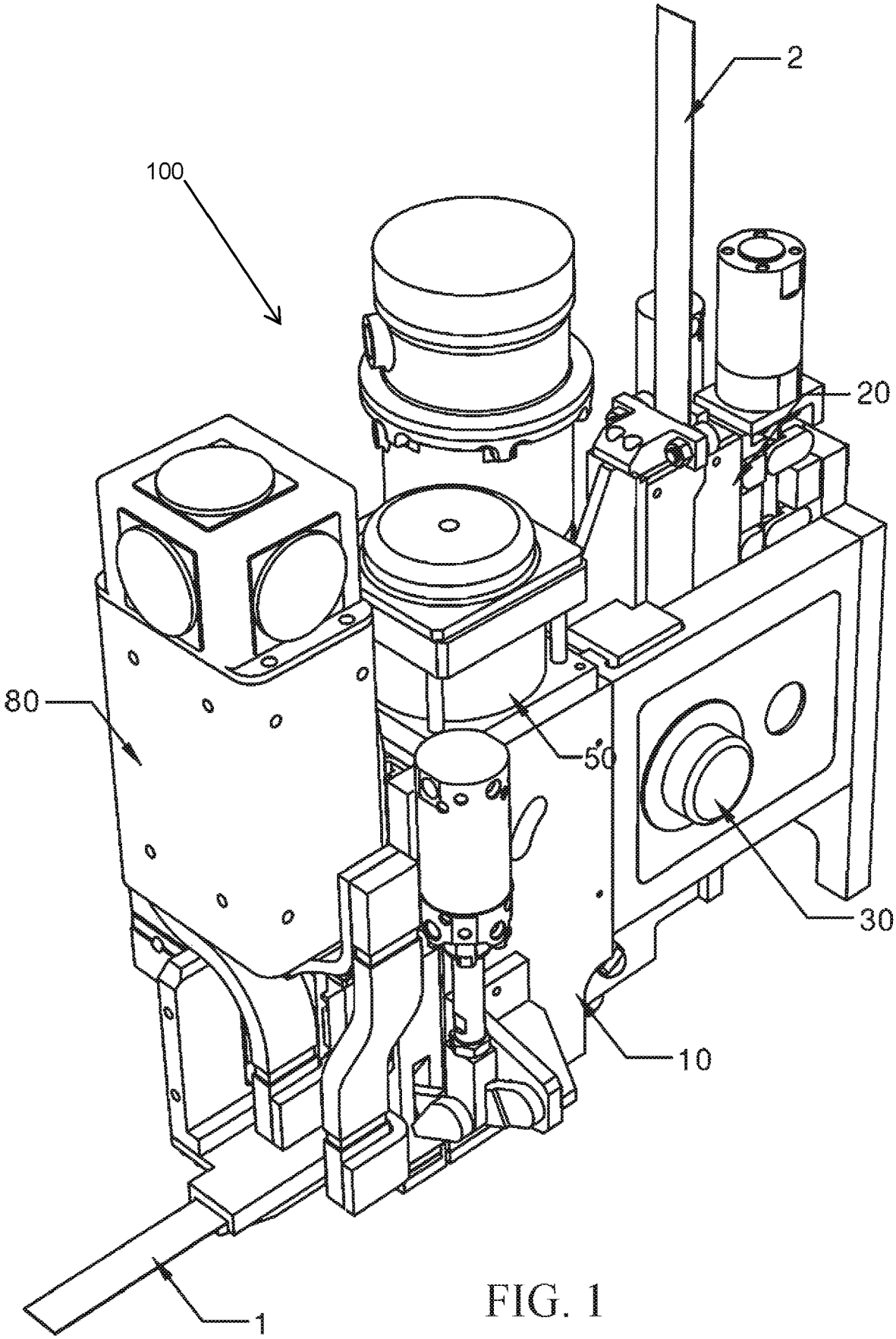
FIG. 1 is a schematic structural view illustrating a strapping head module for coil packaging according to the present invention.

Referring to FIG. 1, is snapping head module (100) for coil packaging according to the present invention may include a frame (10) supporting all the elements, a correction unit (20) disposed at one side of the frame (10) to flatten a band (1), a feeding unit (30) configured to feed a correction unit (20)-passed band, a guide unit (40) configured to guide the band (1) having passed the feeding unit (30), a grip unit (50) gripping and cutting the band (10) transferred again after being winding an entire coil by passing the guide unit (40), and a binding unit binding a band (1) in a mutually overlapped area among the bands (1) winding the coil.

Meantime, the binding unit may be configured by a welding unit (80) binding the band (1) by welding or a sealing unit fixing the band (1) using a separate clamp.

Figure 2:
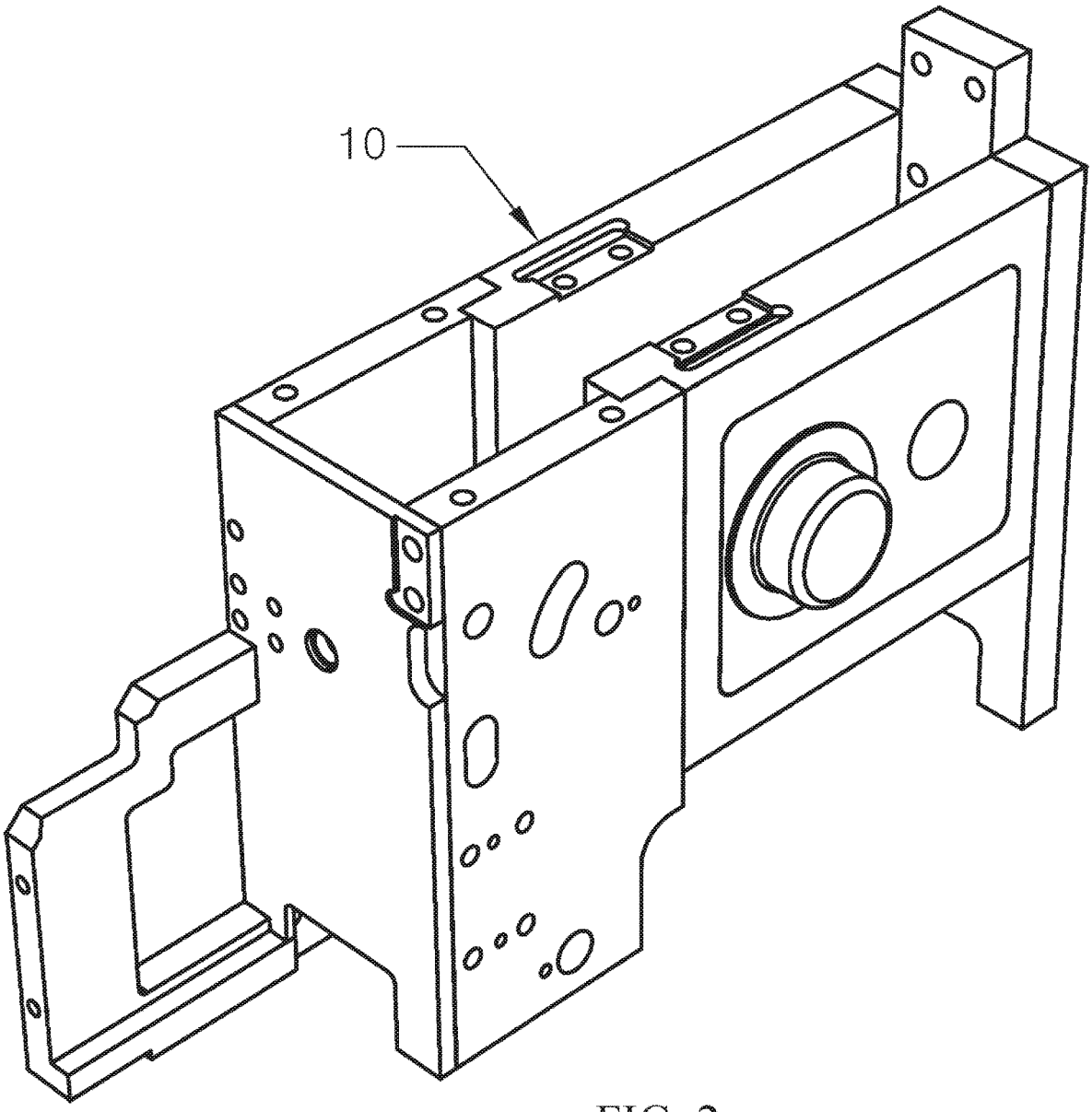
FIG. 2 is a schematic structural view illustrating a frame illustrated in FIG. 1.

First of all, as illustrated in FIG. 2, the frame (10) may be such that a plurality of plates can be detachably configured to a front surface, a rear surface and a lateral surface to enable each component to be conveniently repaired and maintained. Particularly, an area of the feeding unit (30) being disposed may be configured with a detachable separate member to provide a convenience for maintenance and repair of the feeding unit (30).

Figure 3:
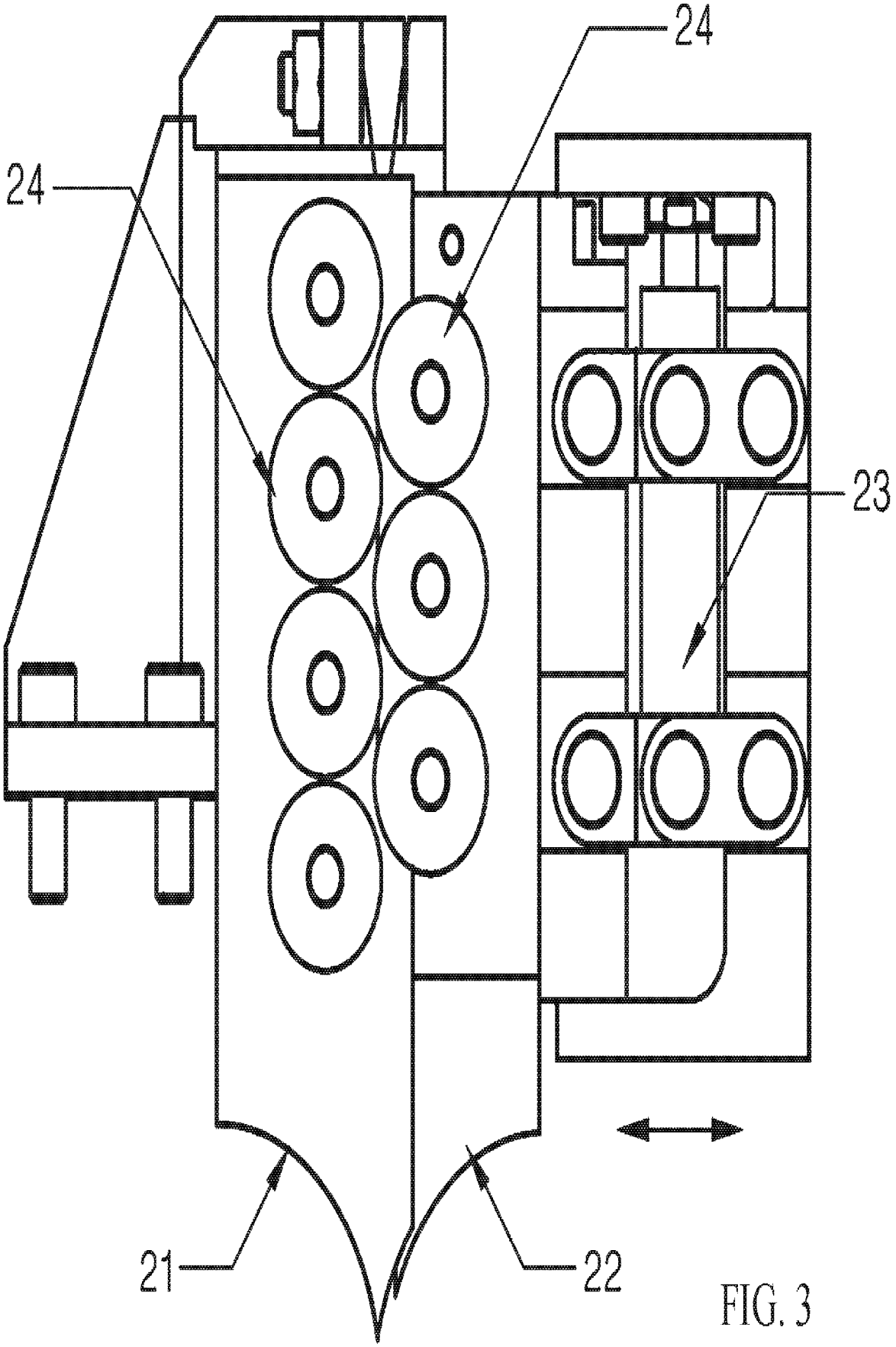
FIG. 3 is a schematic structural view illustrating a correction unit illustrated in FIG. 1.

The correction unit (20), which is a portion where the band (1) is initially supplied as illustrated in FIG. 3, may include a correction base (21) fixed to the frame (10), a correction moving unit (22) transferably fixed to the correction base (21), a correction actuator (23) operating the correction moving unit (22), and a plurality of correction rollers (24) each rotatably bound to the correction base (21) and the correction moving unit (22).

Figure 4:
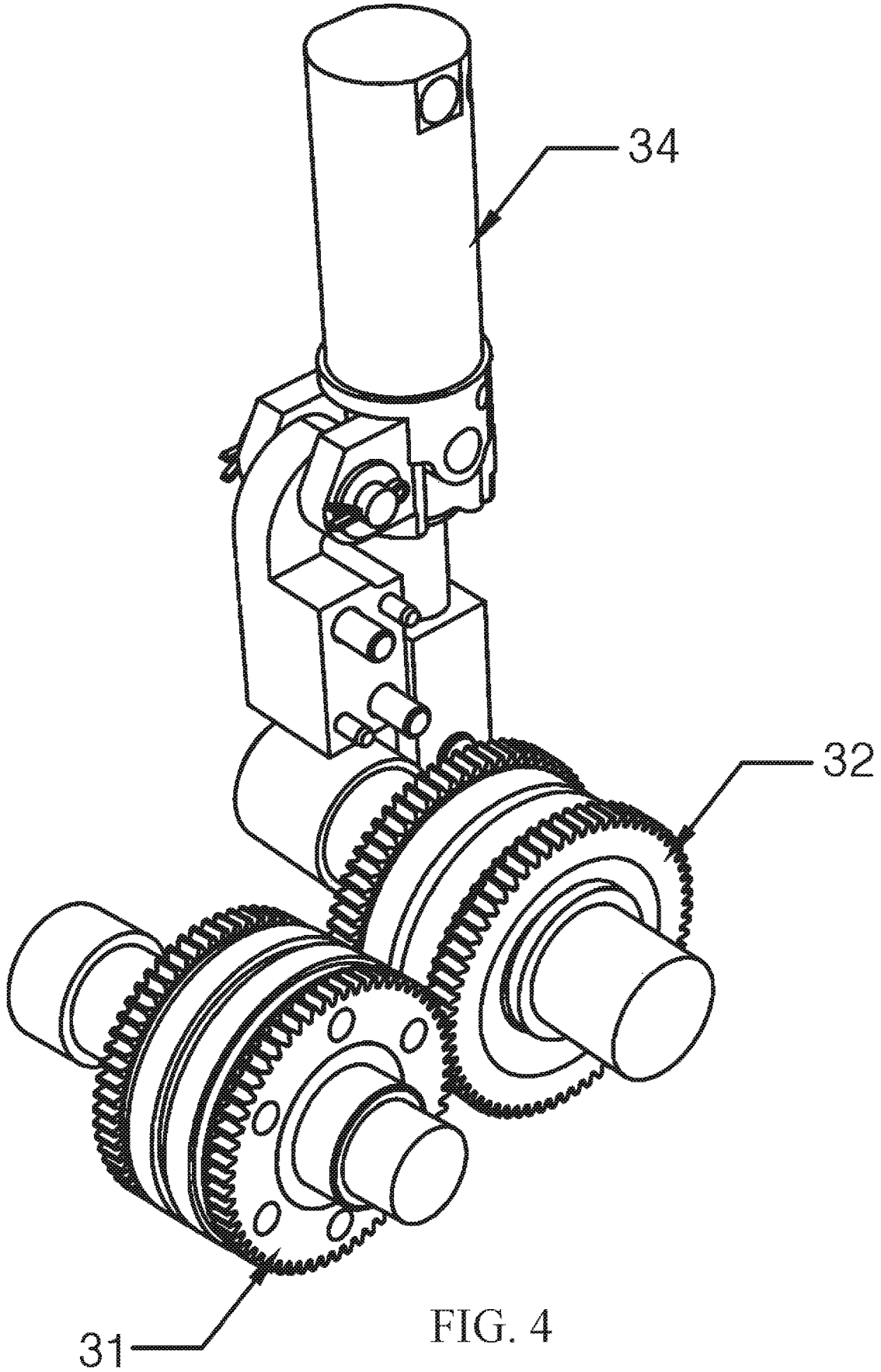
FIG. 4 is a schematic structural view illustrating a feeding unit illustrated in FIG. 1.

At this time, the correction roller (24) may be arranged in a zigzag manner, and function to flatten and remove a curvature formed at the band (1) by being supplied by being initially wound because the band (1) passes between the correction rollers (24). Meantime, the band (1) having passed the correction unit (20) may be supplied by being fed by the feeding unit (30). The feeding unit (30) may be disposed at a lower end of the correction unit (20), and as illustrated in FIG. 4, may be configured by including a driven roller (32) rotating by being meshed with a gear formed at the driving roller (31).

At this time, the driven roller (32) may be configured to rotate by being eccentrically formed in a fine size relative to a central axis. Although the driving roller (31) and the driven roller (32) are meshed by a gear, and because a distance between axes is changed as much as an eccentric amount, the eccentric amount is determined by a value of a degree in which at least the gear can be meshed continuously. Particularly, because the eccentricity can change a pressure of the band (1) disposed between the driven roller (32) and the driving roller (31), there is an advantage of providing an advantageous effect at a step applying a tension to the band (1) by a reverse rotation after winding on the coil is finished.

Figure 5:
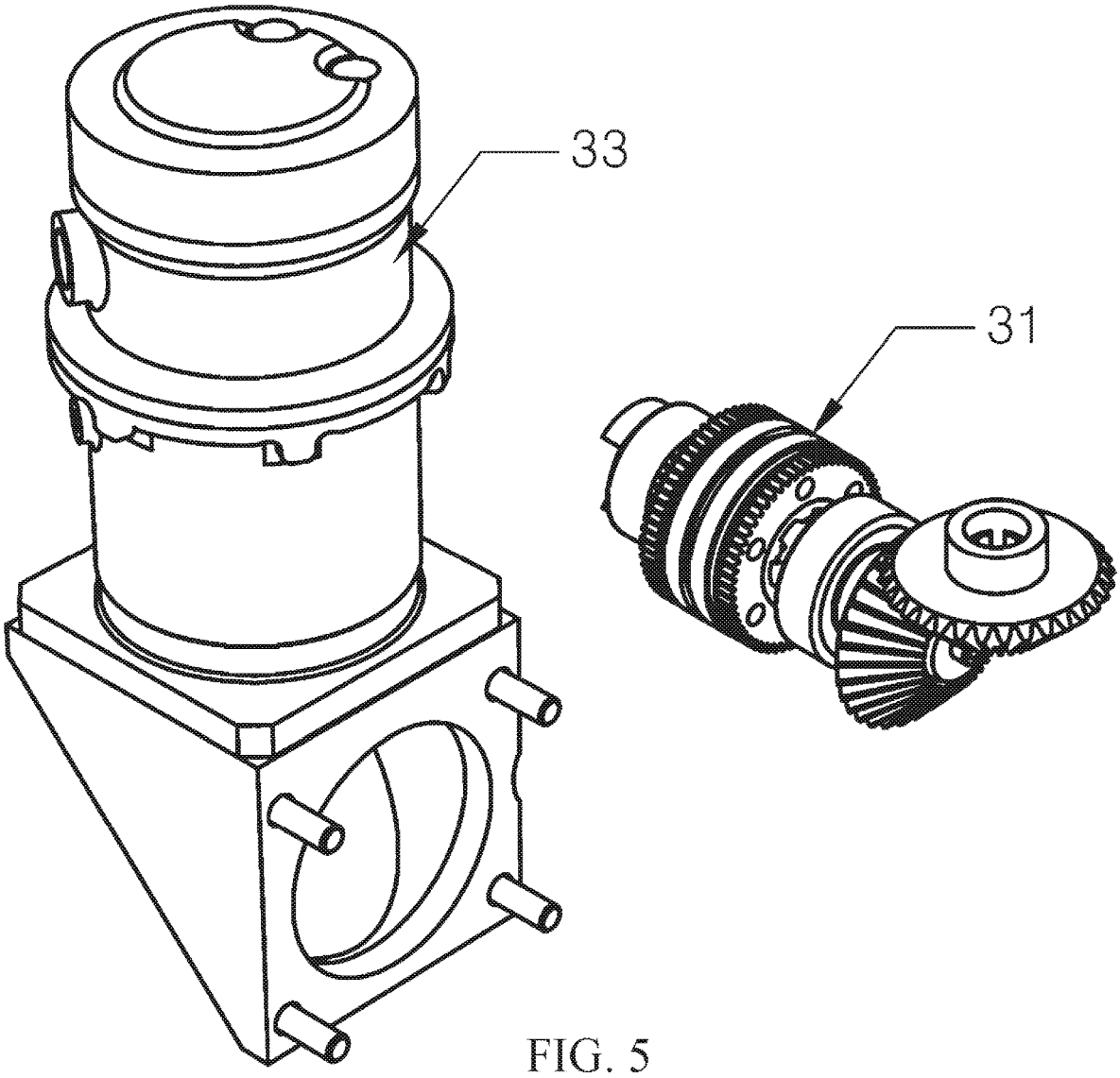
FIG. 5 is a schematic coupled structural view illustrating a driven motor illustrated in FIG. 2.

The central axis of the driving roller (31) may be extensively formed to an outside of the frame (10) and a feeding motor (33) may be directly connected to the central axis, and if necessary, as illustrated in FIG. 5, configuration may be such that a bevel gear is attached to the central axis, and the feeding motor (33) is vertically mounted, whereby a power may be also transmitted through the bevel gear mounted at the feeding motor (33). This type of configuration has an advantage of enhancing a spatial efficiency because the conventionally protruded feeding motor (33) can be mounted to a same direction as that of a lateral surface of the frame (10).

Furthermore, the driven roller (32) may include a separate moving actuator (34) to thereby increase a distance with the driving roller (31) when the band (1) is initially inserted.

Figure 6:
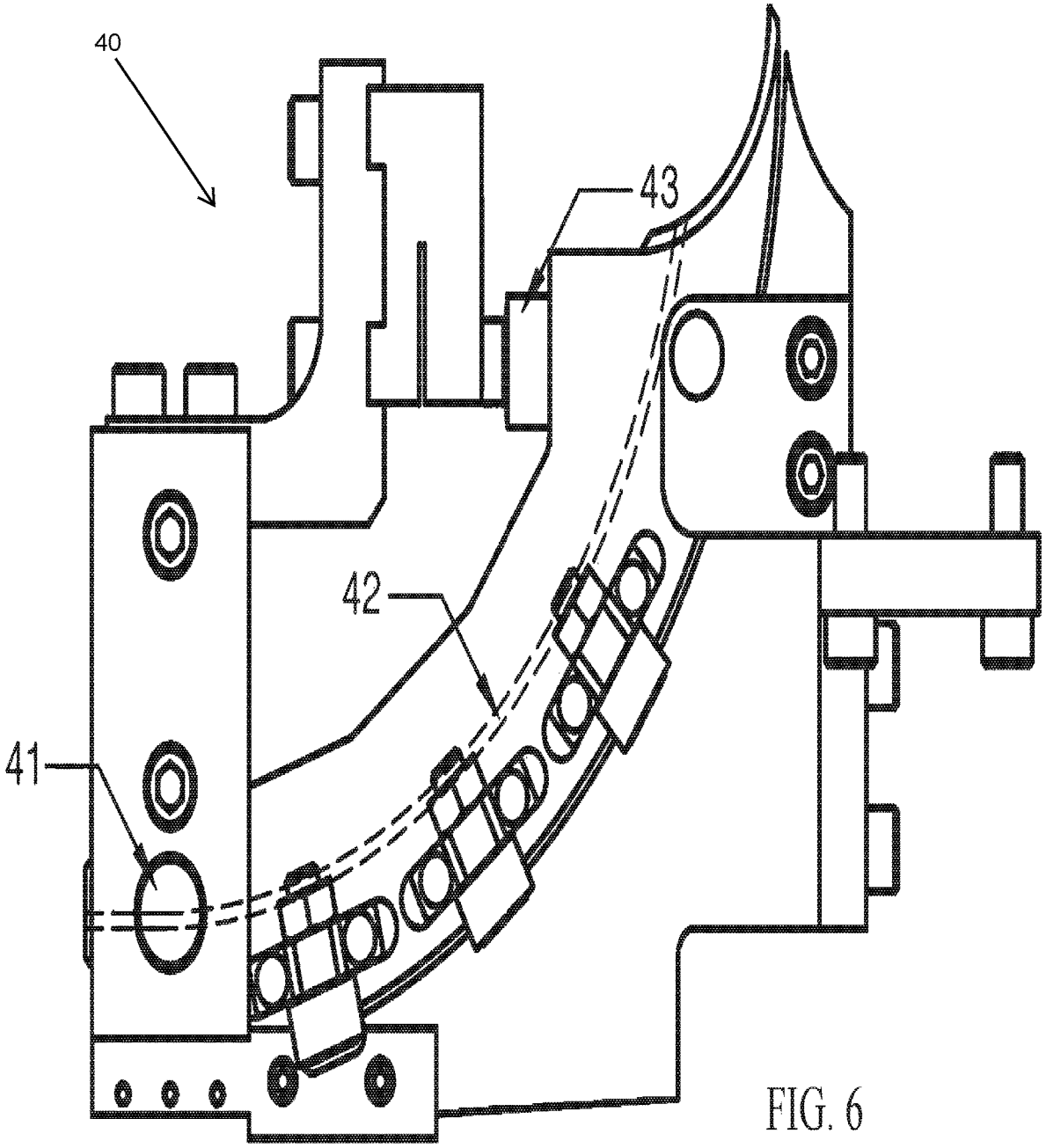
FIG. 6 is a schematic structural view illustrating a guide unit illustrated in FIG. 1.

Furthermore, if necessary, positions of the driven roller (32) and the driving roller (31) may be installed in a direction reverse to that of the example of FIG. 4. Meantime, as illustrated in FIG. 6, the guide unit (40) may be configured in such a manner that one end includes a binge unit (41) hinged to the frame (10), an inside is formed with a guide groove (42) guiding the band (1) and an outside is installed with a plurality of rollers to guide a lateral surface of the band (1).

Particularly, the hinge unit (41) may be disposed at a position opposite to that of the feeding unit (30) and the band (1) may be switched to a 90-degree direction by the guide unit (40). Furthermore, the other end of the guide unit (40) may be contacted by a load cell (43) and when a tension is applied, the load cell can advantageous detect the tension.

Particularly, when a tension is applied after the band (1) is wound on an entire of the coil, the band (1) is reversely transferred to a direction opposite to that of the feeding, and the guide unit (40) may be rotated to a counterclockwise direction, at which time, the load cell detects the force involved in the rotation, whereby whether there is a good binding capable of calculating a tension applied to the band (1) can be advantageously ascertained right away.

Figure 7:
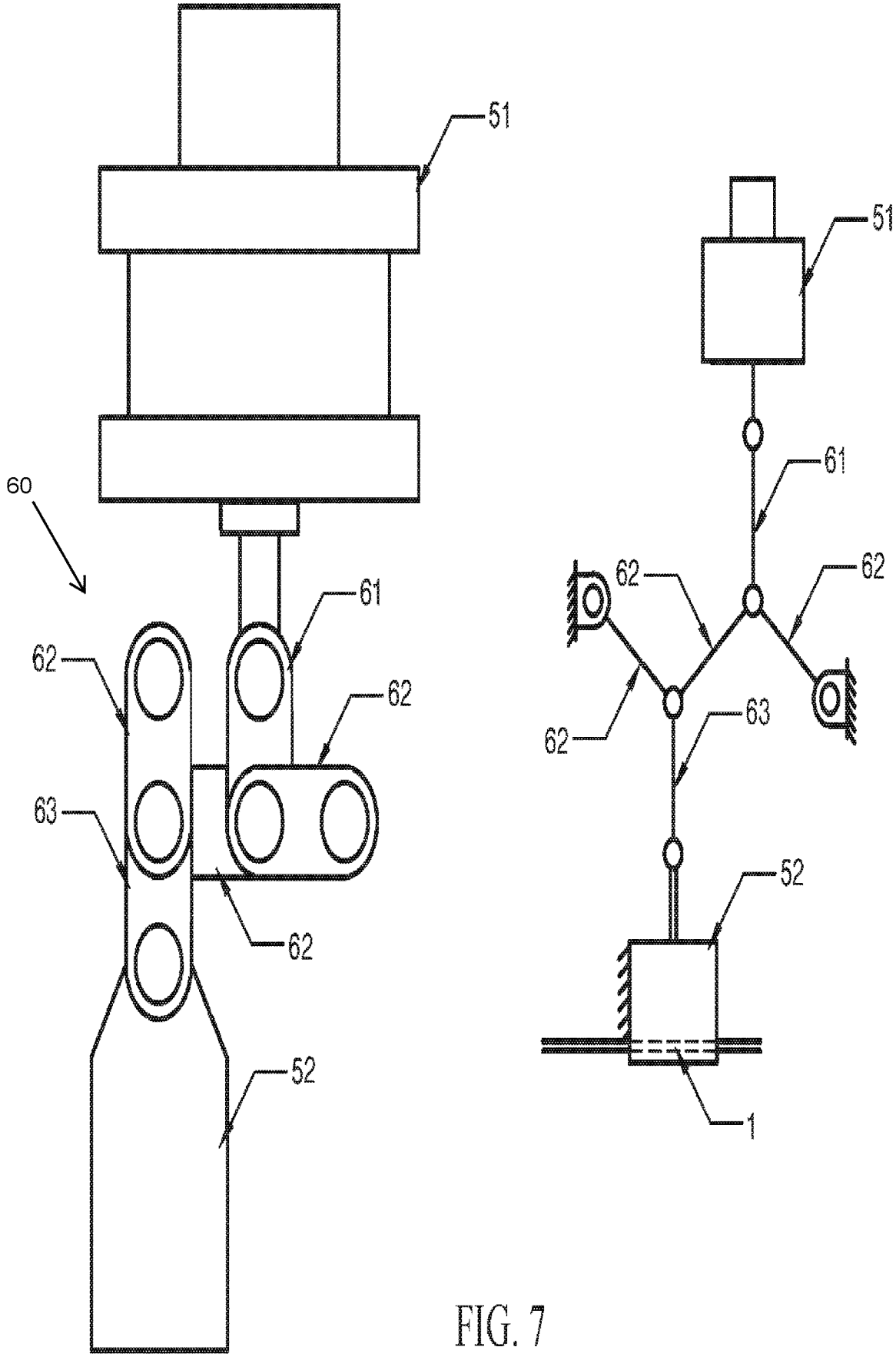
FIG. 7 is a schematic structural view illustrating a grip unit illustrated in FIG. 1.

Meantime, the guide unit (40) may be disposed at a lateral surface with a grip unit (50), where the grip unit (50) may be configured by including a grip actuator (51), a booster unit (60) and a jaw body (52), as illustrated in FIG. 7. The grip actuator (51) may be formed by two pistons on a single cylinder, and driven to generate mutually different forces between a case when an initial band (1) is gripped and a case when the band (1) is cut. Of course, it is preferable that a stronger force be generated during the cutting operation.

Figure 8:
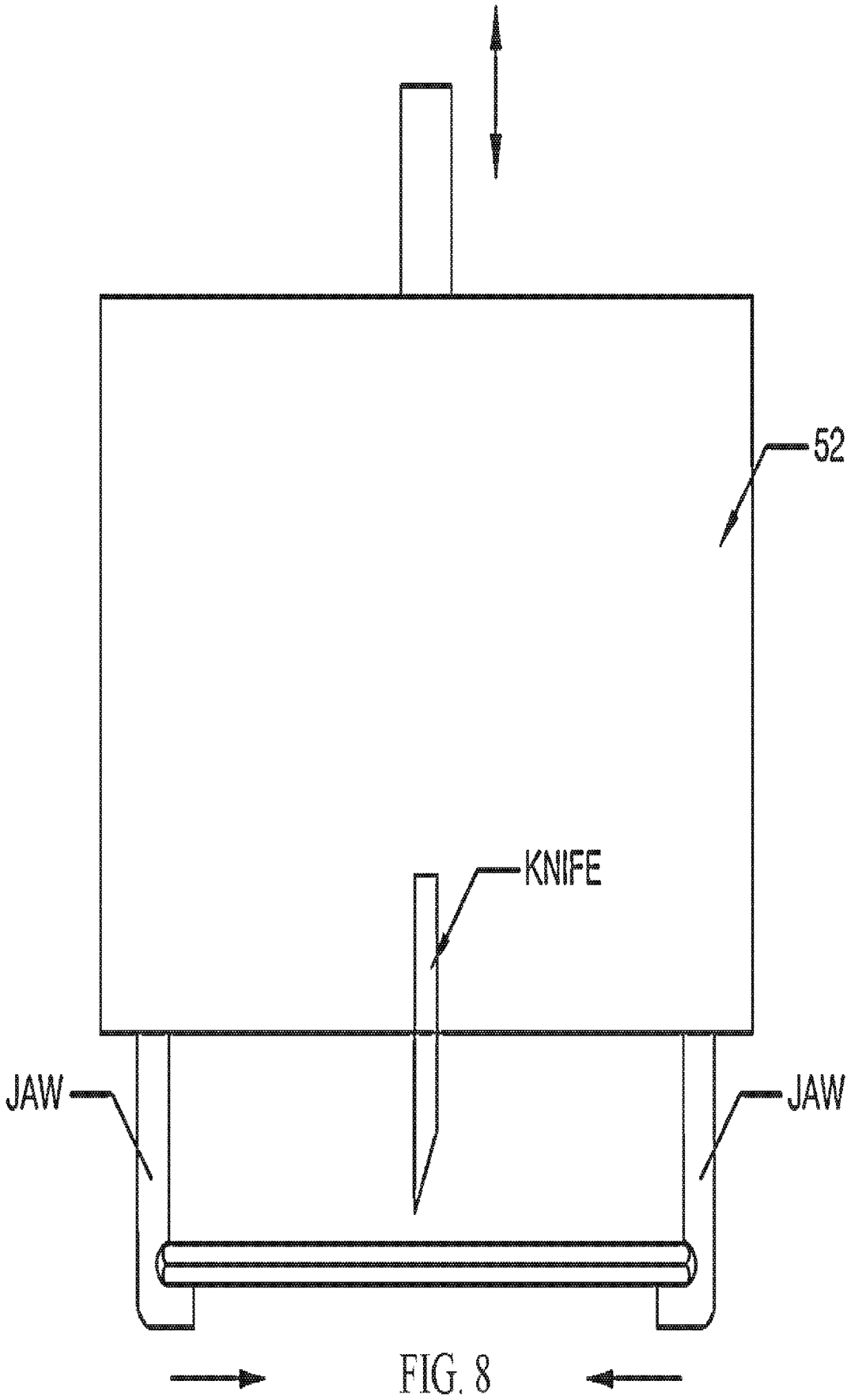
FIG. 8 is a schematic view of operational state of jaw body illustrated in FIG. 7.

Furthermore, the jaw body (52) may perform to cut the band (1) after gripping the transferred band and may be conventionally applied to a strapping head. As shown in FIG. 8, when a load formed at an upper end is applied with a pressure, two jaws formed at a lateral surface of the lower end grips the band (1), and when the load is applied with an additional pressure, a folded band (1) is cut by a knife disposed thereinside. Furthermore, the booster unit (60) may include one input link (61), three intermediate links (62) and one output link (63), where the intermediate links (62) are mutually connected by a hinge, and an end is hinge-bound to the frame (10). One end of the input link (61) may be coupled to an operation unit of the grip actuator (51), and the other end may be coupled to a hinge of the intermediate link (61).

The output link (63) may be connected at one end to a load of the jaw body (52), and the other end may be connected to other hinge of the intermediate link (62).

Thus, when the grip actuator (51) starts to operate, a heavy load may be applied to the jaw body (52) by geometric characteristics of the booster unit (60) to thereby grip and cut the band (1). A binding unit is disposed at a lateral surface of the grip unit (50), and FIG. 9 illustrates a welding unit (80) as an example.

Figure 9:
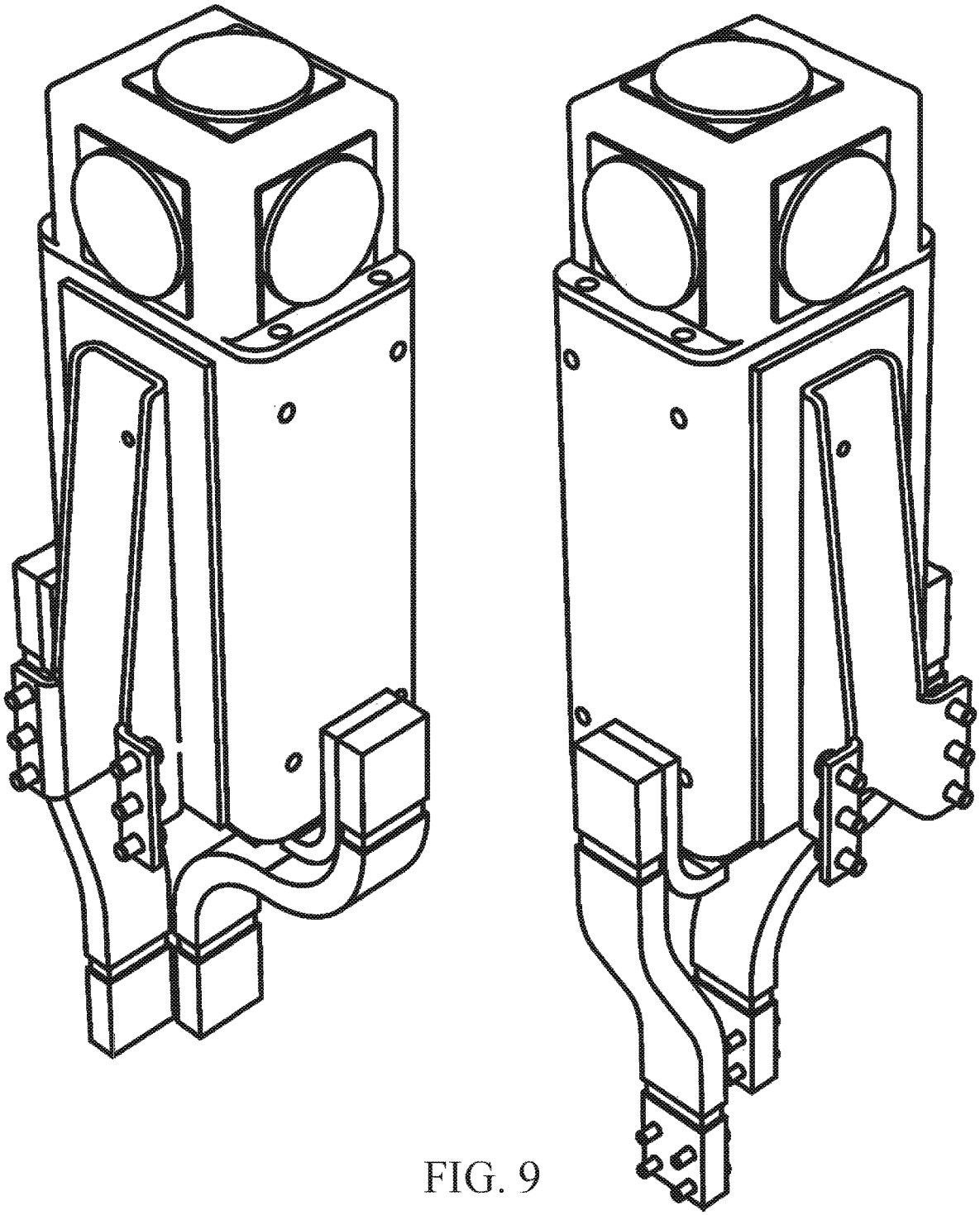
FIG. 9 is a schematic structural view illustrating a welding unit illustrated in FIG. 1.

Referring to FIG. 9, the welding unit (80) may perform a spot welding by an electrode, at which time, the welding unit (80) is in a folded state, a bottom end is inserted by a support plate supporting a bottom end of the band (1) during a welding operation, and the support plate is operated by an actuator installed at the frame (10).

The welding unit (80) may also perform the same function as that of the conventional spot-welding machine, and the present invention is not limited thereto and any similar configuration may be applicable thereto. Furthermore, the binding unit may be configured by a sealing unit binding the band using a clamp, and the function of the sealing unit is same as that of the welding unit (80). Although all the actuators applied to the strapping head module (100) for coil packaging according to the present invention may be realized by a pneumatic method, the feeding unit (33) may be realized by an electrically operated method.

Particularly, the feeding unit (33) needs a precise operation where the band (1) is fed, and a tension is applied by a reverse rotation, such that when realized by the electrically operated method, there is an advantageous effect in the controlling aspect.

Furthermore, the strapping bead module (100) for coil packaging according to the present invention may include a controller fix functional operations such as band (1) feeding, gripping, cutting and welding, and the controller may be configured by including controlling components for performing the abovementioned processes.

Although the abovementioned embodiments according to the present invention have been described in detail with reference to the above specific examples and accompanied drawings, the embodiments are, however, intended to be illustrative only, and thereby do not limit the scope of protection of the present invention. Therefore, the technical scope of the rights for the present disclosure shall be decided by rational interpretation of the appended claims and equivalents thereof.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

The invention claimed is:

1. A strapping head module, for a strapping machine for packaging a steel plate coil, comprising:

a frame formed with a plurality of plates;

a correction unit arranged on one side of the frame to correct a curvature of supplied band;

a feeding unit configured to transfer a band from said correction unit and to apply a tension to the band after said band is completely wound in a coil;

a guide unit configured to guide the band transferred by the feeding unit and to detect a tension applied to the band;

a grip unit configured for damping an end of the band and to cut off the end; and a binding unit configured for binding an overlapped band.

2. The strapping head module of claim 1, wherein the correction unit includes:

a correction base fixed to the frame;

a correction moving unit transferrably coupled to the correction base;

a correction actuator transferring the correction moving unit; and a correction roller arranged on the correction base and the correction moving unit in a zigzag manner to transfer the band.

3. The strapping head module of claim 1, wherein the feeding unit includes:

a driving roller operated by a feeding motor;

a driven roller rolling by being meshed with a gear formed at the driving roller; and a moving actuator moving a rotation shaft of the driven roller.

4. The strapping head module of claim 3, wherein a central axis of the driven roller is eccentrically formed by as much as meshing between the feeding unit and the gear.

5. The strapping head module of claim 4, wherein a feeding motor driving the driving roller is horizontally arranged at an outside of the frame and meshed through the driving roller and a bevel gear.

6. The strapping head module of claim 1, wherein the guide unit includes:

a hinge unit hinged at one end to the frame;

a guide groove formed thereinside to guide the band; and a load cell fixed to the frame to detect a rotating force (torque) of the guide unit.

7. The strapping head module of claim 1, wherein the grip unit includes:

a grip actuator; a jaw body for gripping the transferred band and cutting the band; and a booster unit for transmitting an operation of the grip actuator to the jaw body.

8. The strapping head module of claim 7, wherein the booster unit includes an input link connected to an operation unit of the grip actuator, an output link connected to an operation unit of the jaw body and three links, wherein an end of the links, each connected by a hinge, includes an intermediate link hinged to the frame, and the input link and the output link are respectively connected to a hinge unit of the intermediate links.

9. The strapping head module of claim 1, wherein the binding unit is a welding unit or a sealing unit.

* * * * *